166-66 SR
M7219 XR 4,278,130

United States Patent [19] [11] 4,278,130
Evans et al. [45] Jul. 14, 1981

[54] ACCESS VALVE FOR DRILL STEM TESTING

[75] Inventors: Robert T. Evans; Richard L. Giroux, both of Duncan, Okla.

[73] Assignee: Halliburton Company, Duncan, Okla.

[21] Appl. No.: 85,597

[22] Filed: Oct. 17, 1979

[51] Int. Cl.[3] ..... E21B 33/12; E21B 49/00
[52] U.S. Cl. ..... 166/332; 166/65 R; 166/250
[58] Field of Search ..... 166/321, 324, 332, 318, 166/316, 250, 65 R

[56] References Cited

U.S. PATENT DOCUMENTS

| | | | |
|---|---|---|---|
| 3,051,243 | 8/1962 | Grimmer et al. | 166/332 |
| 3,378,079 | 4/1968 | Page, Jr. | 166/322 |
| 3,675,718 | 7/1972 | Kanady | 166/332 |
| 4,066,128 | 1/1978 | Davis et al. | 166/332 |
| 4,069,865 | 1/1978 | Gazda et al. | 166/113 |
| 4,083,401 | 4/1978 | Rankin | 166/250 |
| 4,094,359 | 6/1978 | King | 166/65 R |
| 4,108,243 | 8/1978 | King et al. | 166/66 |
| 4,109,712 | 8/1978 | Regan | 166/332 |
| 4,116,274 | 9/1978 | Rankin et al. | 166/250 |

*Primary Examiner*—James A. Leppink
*Attorney, Agent, or Firm*—John H. Tregoning; James R. Duzan; Lucian Wayne Beavers

[57] ABSTRACT

An access valve for communicating a wire line pressure sensing probe with a subsurface formation of a well to conduct continuously monitored shut in pressure tests on said subsurface formation. The access valve includes a tubular body having a cylindrical inner surface. A first passage communicates the subsurface formation with the cylindrical inner surface of the tubular body. A sliding valve sleeve has a cylindrical outer surface slidably received in said cylindrical inner surface of said tubular body, and has a valve sleeve port disposed through a side wall thereof communicating said cylindrical outer surface of said sliding valve sleeve with a cylindrical inner surface of said sliding valve sleeve. The sliding valve sleeve is slidable between a closed position wherein the valve sleeve port is in fluid isolation from the first passage, and an open position wherein the valve sleeve port is in fluid communication with the first passage. A probe nose member has a cylindrical outer surface adapted for sliding insertion within said cylindrical inner surface of said sliding valve sleeve, and includes a chamber for receiving a sensing device and a second passage for communicating the chamber with the valve sleeve port when the probe nose member is fully inserted in the sliding valve sleeve.

A bypass allows fluid from the subsurface formation to bypass the tubular body, valve sleeve and probe nose member so that formation pressure may be monitored during either shut in or open flow conditions.

19 Claims, 4 Drawing Figures

ACCESS VALVE FOR DRILL STEM TESTING

Figure 1:
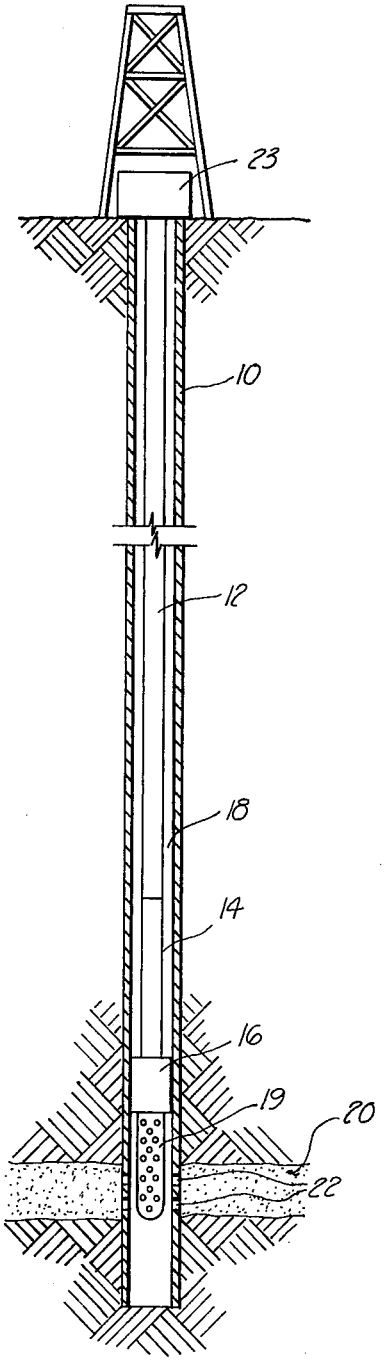

The present invention relates generally to valves for down hole testing equipment, and more particularly, but not by way of limitation, to an access valve for use in continuous monitoring of the shut in pressure of a subsurface formation during drill stem testing procedures.

A procedure generally known as drill stem testing is used to evaluate the potential production of fluids from producing subsurface formations of the well.

Normally, the testing equipment is attached at the lower end of a string of drill pipe commonly referred to as a drill string, and the drill string is then lowered into the well until the testing equipment is located adjacent or a short distance above the subsurface formation to be tested. A conventional packer is then actuated to seal off the annulus between the drill string and a casing of the well at a point above the subsurface formation to be tested.

Appropriate valve means are then closed to shut in the well so that the pressure from the subsurface formation may build up below the packer to the maximum value capable of being produced by the formation.

Much of the equipment used in the prior art, comprises mechanical recorders which have no connection with any indicating equipment on the ground surface above the well, so that the information from the recorder can only be obtained after the drill string and the recorder have been retrieved from the well. The problem with that type of device is that one must guess at the amount of time required for the formation to build up to its peak shut in pressure, and therefore, in order to assure that sufficient time has been allowed, the recording equipment is often left in the shut in well for a much longer period of time than is actually necessary. It is, of course, undesirable to leave the testing equipment in the well for any longer than is actually necessary, because of the very high cost of drilling rig time and the time of operating personnel.

The prior art also includes some measuring apparatus for use in drill stem testing which permits continuous monitoring at the surface of the shut in pressure of the well. Examples of such equipment are shown in U.S. Pat. No. 4,116,274 to Rankin, et al, U.S. Pat. No. 4,108,243 to King, et al, U.S. Pat. No. 4,094,359 to King, U.S. Pat. No. 4,083,401 to Rankin, and U.S. Pat. No. 4,069,865 to Gazda, et al.

These latter devices generally include a measuring device or probe lowered on a wire line into engagement with a receiving member designed to receive the probe and place a pressure sensing device of said probe in fluid communication with the subsurface formation to be tested.

The present invention is utilized with a pressure sensing device similar to those in the latter category in that it is designed for use with a continuously monitored testing device connected to the earth's surface by a wire line for conducting electrical signals from the sensing device.

More specifically, the present invention is directed to an access valve apparatus which provides a means for communicating the pressure sensing probe with the subsurface formation. This novel access valve is used in combination with a separate means for selectively shutting in the well or opening up the well so that the well may flow, thereby providing the capability of monitoring the pressure of the formation during either shut in or open flow conditions.

The access valve apparatus of the present invention includes a tubular body having a cylindrical inner surface. A first passage means has a first end adapted for fluid communication with the subsurface formation of the well and has a second end communicating with said cylindrical inner surface of the tubular body.

A sliding valve sleeve has a cylindrical outer surface slidably received in said cylindrical inner surface of said tubular body, and has a valve sleeve port disposed through a side wall thereof communicating said cylindrical outer surface of said sliding valve sleeve with a cylindrical inner surface of said sliding valve sleeve.

The sliding valve sleeve is slidable between a closed position wherein said valve sleeve port is in fluid isolation from said second end of said first passage means and an open position wherein said valve sleeve port is in fluid communication with said second end of said first passage means.

A probe nose member has a cylindrical outer surface adapted for sliding insertion within said cylindrical inner surface of said sliding valve sleeve, and includes a chamber for receiving a sensing device and a second passage for communicating the chamber with the valve sleeve port when the probe nose member is fully inserted in the sliding valve sleeve.

A bypass is provided around the sliding valve sleeve and the tubular body. A flow valve located below the bypass is movable between an open position allowing fluid to flow from the subsurface formation through the bypass to the top of the well, and a closed position shutting in the well. The flow valve is operable independently of the sliding valve sleeve. The sliding valve sleeve does not affect flow through the bypass. The flow valve does not affect communication of the subsurface formation with the test chamber in which the pressure sensing probe is received.

This arrangement differs significantly from that of the devices disclosed in the references cited above.

With regard to the device disclosed in U.S. Pat. No. 4,108,243 to King, et al, U.S. Pat. No. 4,094,359 to King, and U.S. Pat. No. 4,083,401 to Rankin, that device includes a probe received within a bore of a bypass sub which has a bypass passage therearound. It also includes a sliding sleeve valve which serves as a flow valve to open and close the bypass. This device of King and Rankin does not include an access valve. The sliding sleeve valve of King and Rankin does not function as an access valve because it does not affect communication of the pressure sensing probe with the subsurface formation being tested.

With regard to U.S. Pat. No. 4,069,865 to Gazda, et al, the probe receiving chamber of Gazda, et al, does not include a sliding sleeve valve providing access of the probe with the subsurface formation.

Numerous features and advantages of the present invention will be readily apparent to those skilled in the art upon a reading of the following disclosure in conjunction with the accompanying drawings.

FIG. 1 is a schematic elevation view of a well showing a drill stem test being conducted on a subsurface formation.

Figure 2A:
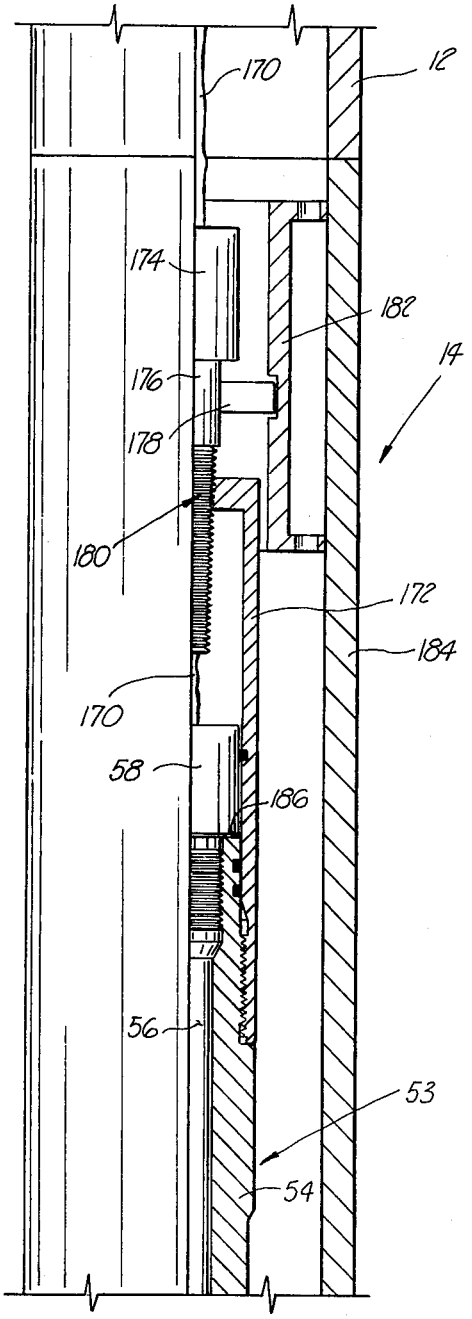
Figure 2B:
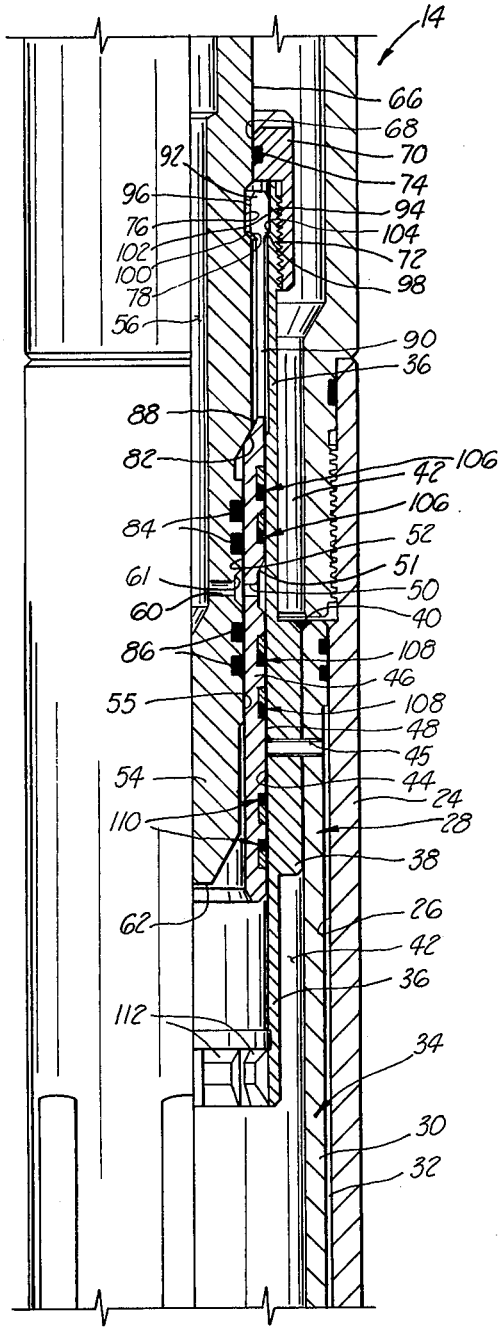
Figure 2C:
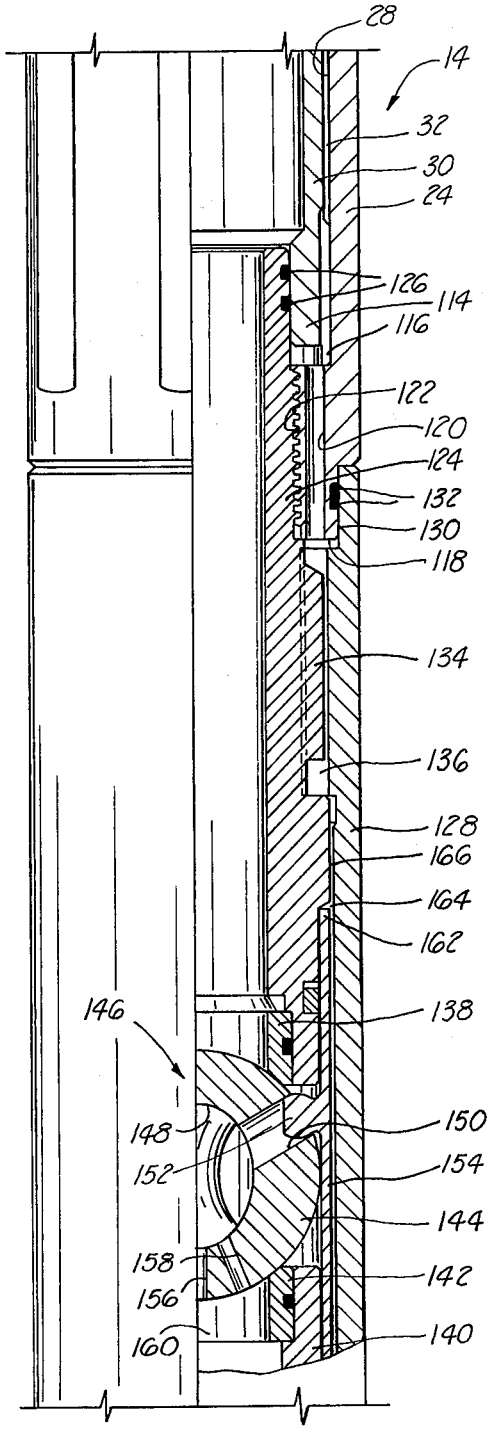

FIGS. 2A–2C comprise a sectional elevation view of the access valve apparatus of the present invention, showing the pressure sensing probe in schematic form only.

Referring now to the drawings, and particularly to FIG. 1, a typical drill stem testing assembly with the access valve apparatus of the present invention is there illustrated. The well upon which the test is being conducted is defined by a well casing 10. A string of drill pipe 12 has been lowered into the well 10. Connected to the lower end of the pipe string 12 is the access valve apparatus of the present invention which is generally designated by the numeral 14. Disposed between an outer surface of access valve apparatus 14 and the inner surface of well casing 10 is a conventional packer means 16 for sealing the annulus 18 between pipe string 12 and well casing 10. Located below packer 16 is a conventional tail pipe 19 through which fluids from subsurface formation 20 are communicated with access valve apparatus 14 in a manner well known to those skilled in the art.

The well casing 10 is generally perforated as illustrated by perforations 22 to allow fluid communication of the subsurface formation 20 with the interior of well casing 10.

The upper end of drill string 12 is connected to conventional above ground equipment 23 which may include surface indicating or monitoring equipment connected to the downhole sensing device by a wire line as is described below.

Referring now to FIGS. 2A–2C, a detailed sectioned elevation view of access valve apparatus 14 is thereshown.

Access valve apparatus 14 includes a cylindrical access valve casing 24 which has a cylindrical inner surface 26.

A cylindrical valve body 23 is disposed within said cylindrical inner surface 26 of valve casing 24, and includes a first portion 30 having an outer diameter less than an inner diameter of said cylindrical inner surface 26 of valve casing 24. The outer surface of first portion 30 of valve body 28 and the inner cylindrical surface 26 of valve casing 24 define an annular cavity 32 therebetween.

Valve body 28 includes an outer tubular member 34 of which first portion 30 is a part, and an inner tubular member 36. Inner tubular member 36 is disposed within and spaced from outer tubular member 34. A radially outward projecting lug 38, which may be referred to as spacer member 38, projects radially outward from inner tubular member 36 and is located between and connects inner tubular member 36 with outer tubular member 34. Spacer member 38 is welded to outer tubular member 34 as indicated at weld 40. Inner and outer tubular members 36 and 34 define an annular space 42 therebetween. The spacer member 38 does not extend completely around inner tubular member 36, so that the annular space 42 extends both above, around, and below spacer member 38.

Annular space 42 provides a bypass around valve body 28 as is described further below, and the annular space 42 may also be referred to as bypass 42.

Valve body 28 includes an inner bore 44. An upper end of annular cavity 32 is communicated with inner bore 44 by a transverse passage 45. A valve sleeve 46 has a cylindrical outer surface 48 which is slidably received within inner bore 44 of valve body 28.

Valve sleeve 46 includes one or more valve sleeve ports 50 disposed through a wall thereof, connecting cylindrical outer surface 48 with a cylindrical inner surface 52 of valve sleeve 46. The ports 50 are communicated with each other by outer annular recess 51.

Valve sleeve 46 is slidable between a closed position, as illustrated in FIG. 2B, wherein said valve sleeve ports 50 are isolated from transverse passage 45, and an open position wherein valve sleeve ports 50 are aligned with and in fluid communication with transverse passage 45.

A probe means 53 includes a probe nose member 54 having a cylindrical outer surface 55 adapted for sliding insertion within cylindrical inner surface 52 of valve sleeve 46. Probe nose member 54 includes a chamber 56 for receiving a sensing device 58. FIGS. 2A–2B show probe nose member 54 fully inserted within valve sleeve 46.

One or more probe nose ports or passages 60 communicate chamber 56 with valve sleeve ports 50. The ports 60 are communicated with each other by outer annular recess 61.

Probe nose member 54 is a generally tubular member having a closed bottom end 62. Nose member 54 includes a second cylindrical outer surface 66 which is sealingly received within an inner bore 68 of valve retainer cap 70. The valve retainer cap 70 is attached to the upper end of inner tubular member 36 of valve body 28 at threaded connection 72. Conventional O-ring seal 74 provides a fluid tight seal between outer cylindrical surface 66 of probe nose member 54 and inner bore 68 of valve retainer cap 70.

Disposed at an intermediate location upon outer cylindrical surface 66 of probe nose member 54 is an outer annular groove or recess 76. The bottom groove 76 is defined by an upward facing tapered shoulder 78.

Located below outer cylindrical surface 66 is reduced diameter outer cylindrical surface 55 which is connected to outer cylindrical surface 66 by a downward facing tapered shoulder 82.

Double O-ring seals 84 are disposed in grooves in reduced diameter surface 55 to provide a fluid tight seal between reduced diameter surface 55 and inner cylindrical surface 52 of valve sleeve 46 above nose ports 60. Similarly, double O-ring seals 86 are disposed in outer cylindrical surface 55 below nose ports 60.

Located above inner cylindrical surface 52 of valve sleeve 46 is radially inner upward facing tapered shoulder 88, constructed for engagement with downward facing tapered shoulder 82 of nose member 54. Extending upwardly above upward facing shoulder 88 are a plurality of radially outwardly biased collet spring fingers 90. Collet fingers 90 provide a releasable locking means for releasably locking valve sleeve 46 in its closed position.

Each of the collet fingers 90 includes an upper end 92. Each upper end 92 includes a radially outward projecting ledge 94 and a radially inward projecting ledge 96. The lower edge of radially outward projecting ledge 94 is defined by a radially outer downward facing tapered surface 98. The lower edge of radially inward projecting ledge 96 is defined by a radially inner downward facing tapered shoulder 100.

When valve sleeve 46 is in its closed position as illustrated in FIG. 2B, the radially outward projecting ledges 94 of collet fingers 90 are resiliently received within an inner annular recess 102 of valve body 28 with downward facing shoulder 98 of radially outward projecting ledges 94 engaging a radially inner upward facing tapered shoulder 104 defining the lower end of annular recess 102. Valve sleeve 46 is thereby locked in its closed position. It may, however, be released from this locked closed position.

This is the position in which valve sleeve 45 is located prior to the insertion of probe nose member 54 therein. The inner diameter between inward projecting ledges 96 of collet fingers 90 when outward projecting ledges 94 are received in recess 102 of valve body 28 is greater than the diameter of outer cylindrical surface 66 of nose member 54. When nose member 54 is inserted in valve sleeve 46, nose member 54 moves downward relative to valve member 46 until tapered shoulders 88 and 82 are engaged. At that point nose member 54 is said to be fully inserted in valve sleeve 46, and nose ports 60 are in fluid communication with valve sleeve ports 50.

When valve sleeve 46 is in its closed position as illustrated in FIG. 2B, there is sufficient clearance between radially inward projecting ledges 96 and outer annular groove 76 of nose member 54, so that a sufficient downwward force exerted on valve sleeve 46 and acting across the engaged tapered surfaces of shoulders 98 and 104 can move the upper ends 92 of collet fingers 90 radially inward out of engagement with annular groove or recess 102 of valve sleeve 46 thereby releasing the valve sleeve 46 from its releasably locked closed position. This permits valve sleeve 46 and nose member 54 to be moved downward relative to valve body 29 to the open position of valve sleeve 46 with valve sleeve ports 50 communicating with transverse passage 45 of valve body 28.

The downward facing shoulder 100 of radially inward projecting ledge 96 is engaged with upward facing shoulder 78 of groove 76 when valve sleeve 46 is moved downward from its locked closed position. The engagement of shoulders 78 and 100 and of shoulders 82 and 88 of nose member 54 and valve sleeve 46, respectively, prevent relative longitudinal movement between nose member 54 and valve sleeve 46 after valve sleeve 46 is moved downward from its locked closed position.

This engagement of shoulders 78 and 100 with shoulders 82 and 88 may be referred to as an interlocking means. This interlocking means also provides a means for pulling valve sleeve 46 upward from its open position to its closed position when probe nose member 54 is pulled upward out of valve sleeve 46.

The cylindrical outer surface 48 of valve sleeve 46 includes a plurality of sealing members for providing fluid tight seals between valve sleeve 46 and valve body 28. Disposed in cylindrical outer surface 48 above valve sleeve ports 50 are a pair of double O-ring seals 106 each of which include metal back up rings. Similarly, below valve sleeve ports 50 are located a second pair of double O-ring seals 108 which also include metal back up rings. And similarly, spaced below the second pair of seals 108 is a third pair of seals 110.

When sliding valve sleeve 46 is in its closed position, as illustrated in FIG. 2B, fluid isolation is provided between valve sleeve ports 50 and transverse passageway 45 by means of the second pair of seals 108. Sealing above valve sleeve ports 50 is provided by the first pair of seals 106 and sealing below the transverse passage 45 is provided by seals 110.

Downward movement of valve sleeve 46 within valve body 28 is limited by a plurality of radially inward projecting lugs 112 of inner tubular member 36 of valve body 28. Lugs 112 may be described as a stop means for engaging valve sleeve 46 and limiting downward movement thereof, so that valve sleeve 46 is in engagement with stop means 112 when the valve sleeve 46 is in its open position.

The lower end 114 of outer tubular member 34 of valve body 28 includes a plurality of downward and radially outward extending fins 116 which keep first portion 30 of valve body 28 spaced inwardly from cylindrical inner surface 26 of valve casing 24, so as to maintain the annular cavity 32.

Extending upwardly from the lower end 118 of valve casing 24 is a longitudinal passage 120 connecting lower end 118 with the lower end of outer tubular member 34 of valve body 28, so that fluid communication is provided between longitudinal passage 120 and annular cavity 32.

Lower end 118 of valve casing 24 includes a radially inner threaded portion 122 to which is threadedly connected an upper flow valve seat holder 124. A fluid tight seal is provided between seat holder 124 and inner tubular member 36 of valve body 28 by a pair of conventional O-ring seals 126.

The lower end of seat holder 124 is received within a flow valve casing 128. The upper end of flow valve casing 128 sealingly engages a reduced diameter outer surface 130 of lower end 118 of valve casing 24 and a fluid tight seal is provided therebetween by conventional O-rings 132.

Seat holder 124 includes a plurality of radially outward extending splines 134 which interlock with a plurality of radially inward projecting splines 136 of flow valve casing 128. This prevents relative rotational movement between seat holder 124 and flow valve casing 128, while permitting fluid flow past said splines 134 and 136. The spaces between splines 134 and 136 are in fluid communication with longitudinal passage 120 of valve casing 24.

Located within the lower end of upper flow valve seat holder 124 is an upper flow valve seat 138.

Located within flow valve casing 128 and spaced below upper flow valve seat holder 124 is a lower flow valve seat holder 140. Contained in the upper end of lower flow valve seat holder 140 is a lower flow valve seat 142.

Sealingly engaged with and retained between upper and lower flow valve seats 138 and 140 is a spherical ball type flow valve 144.

Upper and lower seats 138 and 140 and spherical ball flow valve 144 are all part of a flow valve means generally designated by the numeral 146. The flow valve means 146 is constructed generally in accordance with the teachings of U.S. Pat. No. 3,856,085 to Holden, et al, assigned to the assignee of the present invention, and is operable in response to a change in pressure of a well fluid located in annulus 18. The description of the Holden, et al device is incorporated herein by reference.

Ball valve 144 includes a central bore 148 therethrough. Ball valve 144 is shown in its closed position with central bore 148 oriented transverse to the longitudinal axis of flow valve casing 128.

Ball valve 144 includes a pair of eccentric recesses 150 (only one of which is shown) in which are received lug members 152 of longitudinally extending actuating arms 154. Those components are described in detail in U.S. Pat. No. 3,856,085.

Ball valve 144 includes a plurality of bypass orifices such as orifices 156 and 158, which communicate bore 148 with the interior 160 of lower flow valve seat holder 140 at all times, even when ball valve 144 is in the closed position as illustrated. The interior 160 of lower flow valve seat holder 140 is at all times in fluid communication with the subsurface formation 120 through the tailpipe 19 shown in FIG. 1.

The upper ends 162 of actuating arms 154 are received within an annular space 164 defined between upper flow valve seat holder 124 and flow valve casing 128.

The actuating arms 162, of course, do not extend entirely around annular space 164. The engagement between lug 152 and recess 150 is not a sealing engagement and therefore, well fluid from the subsurface formation 20 is always communicated from interior space 160, through orifices 156 and 158, to bore 148, through recess 150, and past lug 152 into the annular space 164. Annular space 164 is in fluid communication with the space between splines 134 and 136 by means of a clearance 166 between upper flow valve seat holder 124 and flow valve casing 128 located between annular cavity 164 and splines 136.

As previously mentioned, the space between splines 134 and 136 is always in fluid communication with annular cavity 32 through the longitudinal bore 120, so that well fluid from subsurface formation 20 is always in fluid communication with the transverse bore 45 at the upper end of annular cavity 32. The chamber 56 of nose member 54 may therefore always be placed in fluid communication with the subsurface formation 20 by fully inserting nose member 54 in valve sleeve 46 and moving valve sleeve 46 to its open position with valve sleeve ports 50 communicating with transverse passage 45.

Downward movement of the actuating arms 154 from the position shown in FIG. 2C will rotate the ball valve 144 to an open position with the bore 148 aligned with the longitudinal axis of flow valve casing 128. When the flow valve means 146 is in such an open position, well fluid from the subsurface formation 20 may flow upwards through the interior of upper flow valve seat holder 124, and upward through bypass means 42 to the interior of pipe string 12, and on upward to the top of the well 10. When flow valve means 146 is in the closed position as illustrated in FIG. 2C, there is no flow of well fluid to the bypass means 42 and the well is said to be shut in. As mentioned, even when the well is in the shut in position, the well fluid may still be communicated to the chamber 56 of nose member 54 through the passageway previously described.

Flow valve means 146 therefore provides a means for selectively communicating bypass means 42 with and isolating said bypass means 42 from subsurface formation 20 of said well 12. Flow valve means 146 is so constructed that it is operable independent from the operation of valve sleeve 46. This means that when valve sleeve 46 is in either its open or closed position, the flow valve means 146 may also be in its open or closed position. In that manner, the sensing device 58 may be used to measure either shut in or flowing pressures of the subsurface formation 20.

In the description above the various orifices, cavities, etc., of the different components which provide for the flow of well fluid therethrough have been variously described as ports, cavities, recesses, orifices, and passages for the purpose of clarity so that different names could be provided for the different components. It will, however, be understood that any of those components which allow for fluid flow may be generally described as a passage means and the appropriate portion of the passage means previously described may be designated merely by indicating the point of origin and point of termination of the passage means.

The probe 53 is generally lowered into the pipe string 12 upon a conventional wireline 170.

One version of the probe 53 is schematically represented in FIGS. 2A–2B and includes an electric motor 174, a latching mechanism 176, latching protrusion 178, and a threaded extension means 180 which is attached to nose member 54 through nose extension 172 for extending nose member 54 longitudinally relative to electric motor 174. The latching protrusion 178 is engaged with a spider member 182 which is fixedly attached to a probe casing 184 which is connected between pipe string 12 and access valve casing 24.

Such a probe means 53 could be constructed similar to the devices shown in U.S. Pat. No. 4,116,274 to Rankin, et al, U.S. Pat. No. 4,108,243 to King, et al, U.S. Pat. No. 4,094,359 to King, U.S. Pat. No. 4,083,401 to Rankin, and U.S. Pat. No. 4,069,865 to Gazda, et al, in addition to a latching means such as that shown in U.S. Pat. No. 3,064,737 to Quinn. As the components of the probe 53 other than nose member 54 do not comprise a part of the present invention, they are shown only in schematic form.

The manner of conducting a continuously monitored drill stem pressure test of the subsurface formation 20 utilizing the access valve apparatus 14 and probe 53 just described, is generally conducted as follows.

This method will be described beginning at the point before the drill string 12 is even lowered into the well 10. First the access valve apparatus 14 is connected to the first section of drill pipe making up the drill string 12. Then the drill string 12 with the access valve apparatus 14 connected thereto is lowered into the well 10 until the access valve apparatus 14 is located adjacent or slightly above the subsurface formation 20 to be tested.

Then the packer means 16 shown in FIG. 1 is expanded to seal annulus 18 between pipe string 12 and well 10 at a point located above subsurface formation 20. Next, the probe 53 is lowered on wire line 170 into the pipe string 12. The probe 53 is lowered until probe nose member 54 engages valve sleeve 46 which is in its locked closed position. Then it is necessary to exert a downward force upon nose member 54 to fully insert nose member 54 into valve sleeve 46 and to move valve sleeve 46 to its open position to communicate chamber 56 with the subsurface formation 20.

Depending upon the design of probe 53 this downward force may be exerted upon nose member 54 and valve sleeve 46 in various ways. For example, with a probe assembly such as that schematically illustrated in FIG. 2A, the probe 53 is lowered until the latching protrusion 178 is located adjacent spider member 182 and then the latching protrusion 178 is extended by latching mechanism 176 to latchingly engage spider member 182 thereby anchoring electric motor 174 relative to probe casing 184. Then the electric motor actuates the extension means 180 to move probe nose member 54 downward relative to probe casing 184. The downward force being exerted upon nose member 54 is transmitted to valve sleeve 46, thereby inserting nose member 54 in valve sleeve 46 and then moving probe nose member 54 and valve sleeve 46 downward until valve sleeve 46 is in its open position. The necessary downward force on probe nose member 54 could also be provided by merely running a sufficient weight (not shown) on wire line 170 above probe 53 so that the weight could be set down upon probe 53 thereby transmitting said weight to nose member 54 to urge it to move downwardly.

The flow valve means 146 will generally be closed during the lowering of the probe 53 into the well, so that the upward flow of well fluid through drill string 12 does not inhibit the downward movement of probe 53. After the nose member 54 is fully inserted in valve sleeve 46 and valve sleeve 46 is moved to its open position, it is sometimes desirable to open flow valve means 146 to allow the subsurface formation 20 to flow for a while. Then the flow valve means 146 will be closed to shut in subsurface formation 20. The pressure developed by subsurface formation 20 will then build up to a maximum shut in value over a period of time after the flow valve means 146 has been closed. This pressure can be continuously sensed by pressure sensing device 58. A signal from sensing device 58 is transmitted through wire line 170 to a receiver located above ground. The receiver may be considered to be part of the above ground equipment 23 schematically illustrated in FIG. 1.

The above ground equipment is used to continuously monitor the signal transmitted from sensing device 58. Due to this continuous monitoring, it is easy to determine when the maximum shut in pressure of the subsurface formation 20 has been reached so that it may be determined when the test should be terminated.

When the test is terminated, the wire line 170 and probe 53 are pulled out of the pipe string 12. The engagement of upward facing shoulder 78 of nose member 54 with downward facing shoulders 100 of inward projecting ledges 96 of collet fingers 90 causes valve sleeve 46 to be pulled up to its closed position, at which point the collet fingers 90 move radially outward releasing nose member 54.

Thus it is seen that the access valve for drill stem testing of the present invention is readily adapted to attain the ends and advantages mentioned as well as those inherent therein. While presently preferred embodiments of the invention have been described for the purposes of this disclosure, numerous changes in the construction and arrangement of parts can be made by those skilled in the art, which changes are encompassed within the spirit of this invention as defined by the appended claims.

What is claimed is:

1. An access valve apparatus for communicating a sensing device with a subsurface formation of a well, said apparatus comprising:

a cylindrical valve casing having a cylindrical inner surface and having an upper end connected to a pipe string;

a cylindrical valve body disposed concentrically within said cylindrical inner surface of said valve casing and held in place relative to said valve casing;

first passage means for communicating said subsurface formation of a well with an inner bore of said valve body;

a valve sleeve having a cylindrical outer surface slidably received within said inner bore of said valve body and having a port disposed therethrough connecting said cylindrical outer surface of said valve sleeve with a cylindrical inner surface of said valve sleeve, said valve sleeve being slidable between a closed position wherein said port is isolated from said first passage means and an open position wherein said port is in fluid communication with said first passage means;

a probe nose member having a cylindrical outer surface adapted for sliding insertion within said cylindrical inner surface of said valve sleeve, said probe nose member including a chamber for receiving said sensing device and a second passage means for communicating said chamber with said port of said valve sleeve; and a bypass means, disposed radially outward from said inner bore of said valve body, for allowing fluid from said subsurface formation to bypass said valve body, valve sleeve and probe nose member and flow upward through said pipe string to a top of said well;

wherein said valve body, first passage means, valve sleeve, probe nose member and bypass means provide a means for communicating said sensing device with said subsurface formation during both shut in and open flow conditions of said well.

2. The access valve apparatus of claim 1, wherein:

said valve body includes a first portion having an outer diameter less than an inner diameter of said cylindrical inner surface of said valve casing, so that an annular cavity is defined between said outer diameter of said first portion of said valve body and said cylindrical inner surface of said valve casing; and said annular cavity comprises a portion of said first passage means.

3. The access valve apparatus of claim 1, wherein:

said valve body includes an outer tubular member and an inner tubular member disposed within and spaced from said outer tubular member, with a spacer member located between and connecting said inner and outer tubular members so that an annular space is defined between said inner and outer tubular members, said annular space comprising a part of said bypass means.

4. The access valve apparatus of claim 1, further comprising:

releasable locking means for releasably locking said valve sleeve in its said closed position.

5. The access valve apparatus of claim 4, wherein said releasable locking means comprises:

an annular recess disposed in said inner bore of said valve body; and a plurality of collet fingers extending upwardly from said valve sleeve, each of said collet fingers having an upper end with a ledge projecting radially outward therefrom, said collet fingers being outwardly biased and so arranged and constructed that when said valve sleeve is in its said closed position said ledges of said collet fingers are resiliently engaged in said annular recess of said valve body.

6. The access valve apparatus of claim 5, wherein:

said annular recess of said valve body has a lower tapered surface; and said ledges of said collet fingers have lower tapered surfaces which engage said lower tapered surface of said annular recess when said valve sleeve is releasably locked in its closed position, so that a sufficient downward force exerted on said valve sleeve and acting across said engaged tapered surfaces can move said ledges radially inward out of engagement with said annular recess thereby releasing said valve sleeve and allowing it to move downward to its open position.

7. The access valve apparatus of claim 6, wherein:

said probe nose member and said valve sleeve further include interlocking means for preventing relative longitudinal movement between said probe nose member and said valve sleeve when said sliding valve sleeve is in its said open position.

8. The access valve apparatus of claim 7, wherein:

said probe nose member includes a radially outer outward facing shoulder and includes a radially outer downward facing shoulder located below said upward facing shoulder;

said valve sleeve includes a radially inner upward facing shoulder, located below said collet fingers, for engagement with said downward facing shoulder of said nose member; and said upper ends of said collet fingers of said valve sleeve include radially inner downward facing shoulders for engagement with said upward facing shoulder of said nose member when said valve sleeve is released from its locked closed position, said engagement of said upward and downward facing shoulders of said nose member with said radially inner downward facing shoulders of said collet fingers and said upward facing shoulder of said valve sleeve, respectively, preventing relative longitudinal movement between said nose member and valve sleeve when said valve sleeve is located below its locked closed position.

9. An access valve apparatus for communicating a sensing device with a subsurface formation of a well, said apparatus comprising:

a tubular body having a cylindrical inner surface;

first passage means having a first end adapted for fluid communication with said subsurface formation of said well and having a second end communicating with said cylindrical inner surface of said tubular body;

a sliding valve sleeve having a cylindrical outer surface slidingly received in said cylindrical inner surface of said tubular body, and having a valve sleeve port disposed through a side wall thereof, said sliding valve sleeve being slidable between a closed position wherein said valve sleeve ports is in fluid isolation from said second end of said first passage means and an open position wherein said valve sleeve port is in fluid communication with said second end of said first passage means;

a probe nose member having a cylindrical outer surface adapted for sliding insertion within a cylindrical inner surface of said sliding valve sleeve, and including a chamber for receiving said sensing device and a second passage means for communicating said chamber with said valve sleeve port; and bypass means for allowing fluid from said subsurface formation to bypass said tubular body, valve sleeve and probe nose member and flow upward through a pipe string connected to an upper end of said access valve apparatus;

wherein said tubular body, first passage means, valve sleeve, probe nose member and bypass means provide a means for communicating said sensing device with said subsurface formation during both shut in and open flow conditions of said well.

10. The access valve apparatus of claim 9, wherein:

said sliding valve sleeve includes stop means for limiting downward movement of said probe nose member within said sliding valve sleeve, so that when said probe nose member is fully inserted within said sliding valve sleeve said probe nose member is in engagement with said stop means and said second passage means is in fluid communication with said valve sleeve port; and said probe nose member and said sliding valve sleeve are so arranged and constructed that downward force on said probe nose member is transmitted to said sliding valve sleeve through said stop means when said probe nose member is fully inserted in said sliding valve sleeve.

11. The access valve apparatus of claim 9, wherein:

said bypass means is an annular bypass means disposed radially outward from said cylindrical inner surface of said tubular body.

12. The access valve apparatus of claim 9, wherein:

said probe nose member and said sliding valve sleeve further include interlocking means for preventing relative longitudinal movement between said probe nose member and said sliding valve sleeve when said sliding valve sleeve is in its said open position.

13. The access valve apparatus of claim 12, wherein:

said interlocking means is further characterized as being a means for pulling said sliding valve sleeve upward from its said open position to its said closed position when said probe nose member is pulled upward out of said sliding valve sleeve.

14. The access valve apparatus of claim 9, further comprising:

releasable locking means for releasably locking said sliding valve sleeve in its said closed position.

15. The access valve apparatus of claim 14, wherein said releasable locking means comprises:

an annular recess disposed in said cylindrical inner surface of said tubular body; and a plurality of collet fingers extending upwardly from said sliding valve sleeve, each of said collet fingers having an upper end with a radially outward extending ledge projecting therefrom, said collet fingers being outwardly biased so that when said sliding valve sleeve is in its said closed position said outward extending ledges of said collet fingers are received in said annular recess of said tubular body thereby locking said sliding valve sleeve in its said closed position until a sufficient downward force is exerted on said sliding valve sleeve to overcome said outward bias of said collet fingers to release said sliding valve sleeve allowing it to move downward to its open position.

16. The access valve apparatus of claim 15, wherein:

said upper ends of said collet fingers of said releasable locking means each further include a radially inward extending ledge projecting therefrom; and said probe nose member includes an outer annular recess located adjacent said radially inward extending ledges of said collet fingers when said probe nose member is fully inserted in said sliding valve sleeve, said outer annular recess of said probe nose member and said collet fingers being so constructed that when said sliding valve sleeve is moved downward from its said close position said radially inward extending ledges of said collet fingers are received in said outer annular recess of said probe nose member, thereby preventing relative longtudinal movement between said probe nose member and said sliding valve sleeve.

17. The access valve apparatus of claim 14, wherein:

said sliding valve sleeve includes stop means for limiting downward movement of said probe nose member within said sliding valve sleeve, so that when said probe nose member is fully inserted within said sliding valve sleeve said probe nose member is in engagement with said stop means and said second passage means is in fluid communication with said valve sleeve port; and said probe nose member and said sliding valve sleeve are so arranged and constructed that downward force on said probe nose member is transmitted to said sliding valve sleeve through said stop means when said probe nose member is fully inserted in said sliding valve sleeve.

18. The access valve apparatus of claim 17, wherein:

said probe nose member and said sliding valve sleeve further include interlocking means for preventing relative longitudinal movement between said probe nose member and said sliding valve sleeve when said sliding valve sleeve is in its said open position.

19. The access valve apparatus of claim 18, wherein:

said interlocking means is further characterized as being a means for pulling said sliding valve sleeve upward from its said open position to its said closed position when said probe nose member is pulled upward out of said sliding valve sleeve.

* * * * *